US009833679B2

(12) United States Patent
Cruz

(10) Patent No.: US 9,833,679 B2
(45) Date of Patent: Dec. 5, 2017

(54) SECURING DEVICE FOR GOLF HAVING REMOVABLE STUDS

(71) Applicant: Roberto Serrano Cruz, Atizapan (MX)

(72) Inventor: Roberto Serrano Cruz, Atizapan (MX)

(73) Assignee: Roberto Serrano Cruz, Atizapan (MX)

( * ) Notice: Subject to any disclaimer, the term of this patent is extended or adjusted under 35 U.S.C. 154(b) by 24 days.

(21) Appl. No.: 14/648,044

(22) PCT Filed: Nov. 5, 2013

(86) PCT No.: PCT/MX2013/000132
§ 371 (c)(1),
(2) Date: May 28, 2015

(87) PCT Pub. No.: WO2014/084703
PCT Pub. Date: Jun. 5, 2014

(65) Prior Publication Data

US 2015/0297968 A1 Oct. 22, 2015

(30) Foreign Application Priority Data

Nov. 29, 2012 (MX) ..... MX/A/2012/013915

(51) Int. Cl.

| | |
|---|---|
| ***A63B 69/36*** | (2006.01) |
| ***A63B 69/00*** | (2006.01) |
| ***A63B 57/00*** | (2015.01) |
| ***A43D 999/00*** | (2006.01) |
| ***A43C 15/16*** | (2006.01) |
| ***A63B 57/10*** | (2015.01) |
| *A63B 71/06* | (2006.01) |

(52) U.S. Cl.
CPC ..... *A63B 69/0057* (2013.01); *A43C 15/161* (2013.01); *A43D 999/00* (2013.01); *A63B 57/00* (2013.01); *A63B 57/10* (2015.10); *A63B 69/0059* (2013.01); *A63B 69/3608* (2013.01); *A63B 69/3667* (2013.01); *A63B 2069/0062* (2013.01); *A63B 2071/0694* (2013.01); *A63B 2208/0204* (2013.01)

(58) Field of Classification Search
USPC ..... 473/217, 218, 252, 266, 270, 272, 273, 473/409, 452
See application file for complete search history.

(56) References Cited

U.S. PATENT DOCUMENTS 3,606,341 A * 9/1971 Honbarger ..... A63B 69/3608 473/217
3,731,405 A 5/1973 Kincaid
4,122,577 A * 10/1978 Catania ..... A46B 15/00 15/160

(Continued)

FOREIGN PATENT DOCUMENTS

JP 2003220162 A 8/2003

*Primary Examiner* — Nini Legesse
(74) *Attorney, Agent, or Firm* — Edwin S. Flores; Chalker Flores LLP

(57) ABSTRACT

The golf shoe holder with dismountable threaded cleats prevents the supporting foot of a person from moving when attempting to hit the golf ball with a golf club. This is achieved as the holder has two holes with different diameters: the large diameter is to be held between the cleats and the golf shoe sole, by means of the threads that both parts have, and the small diameter is where it holds on to the grass by means of a tee.

8 Claims, 3 Drawing Sheets

(56) References Cited

U.S. PATENT DOCUMENTS

| | | | | | |
|---|---|---|---|---|---|
| 4,407,079 | A * | 10/1983 | Chiroff | ..... | A63B 69/3608 36/127 |
| 5,029,869 | A | 7/1991 | Veasey | | |
| 5,150,903 | A * | 9/1992 | Percic | ..... | A63B 69/3673 36/127 |
| 6,638,176 | B1 | 10/2003 | Hayes | | |
| 7,654,014 | B1 * | 2/2010 | Moore | ..... | A43B 3/0042 36/127 |
| 2011/0003652 | A1 * | 1/2011 | Brend | ..... | A63B 21/1403 473/452 |
| 2012/0329567 | A1 * | 12/2012 | Rammos | ..... | A63B 69/3623 473/217 |

* cited by examiner

SECURING DEVICE FOR GOLF HAVING REMOVABLE STUDS

This invention refers to a shoe holder that specifically serves to prevent the foot that provides support from moving when attempting to hit the ball with the golf club; the supporting foot is determined as follows: when a person is right handed, it is the left foot, and when the person is left handed, it is the right foot.

INVENTION BACKGROUND

Within the field of golf, it is considered as a defect that at the time of trying to hit the golf ball with the golf club, the support foot moves, which causes instability to the body and making, in turn, that the ball that is hit goes off in a direction other than the direction desired by the golfer.

DESCRIPTION OF THE INVENTION

The following U.S. Pat. No. 5,150,903, refers to (a training device for fastening the bottom of the heel of a golf shoe with the device comprising an opened plate, which is secured to the bottom of the heel by removing the cleats in the heel, placing the plate against the bottom of the heel and reinserting the cleats in the heel after penetrating the apertures in the plate. The plate is provided with a tab extending laterally there from over a portion of the periphery of the heel of the shoe. A spike is secured to the tab to extend laterally of the bottom of the heel for penetrating the ground to hold the leading foot of a golfer in place during a practice stance.

This patent does not divulge an aid for the golfer to hold the golf shoe sole, to the golfer's foot.

The previous document closest to my proposal does not divulge a device similar to a golf shoe holder with dismountable cleats.

Figure 1B:
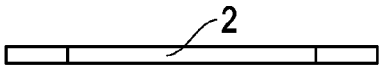
Figure 1:
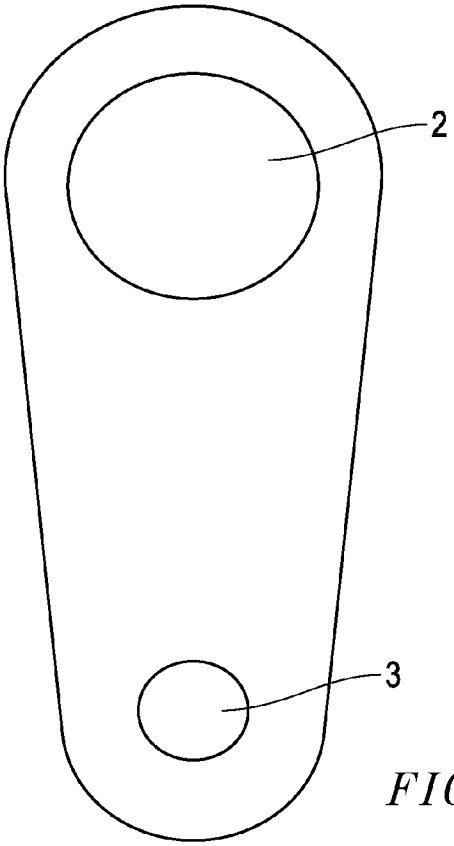

To supplement the description being made and with the purpose of aiding in better understanding the invention characteristics, attached to this description as an integral part hereof, are the drawings and photos, where the following is shown, without limitation:

FIG. 1. It shows a perspective of the golf shoe holder.

Figure 1C:
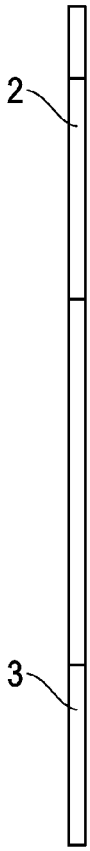
Figure 1A:
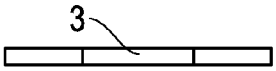

FIG. 1A. It shows a horizontal front view of the golf shoe holder from the thinnest side.

FIG. 1B. It shows a horizontal front view of the golf shoe holder from the widest side opposite the side shown in FIG. 1A.

FIG. 1C. It shows a horizontal side view of the golf shoe holder.

Figure 2A:
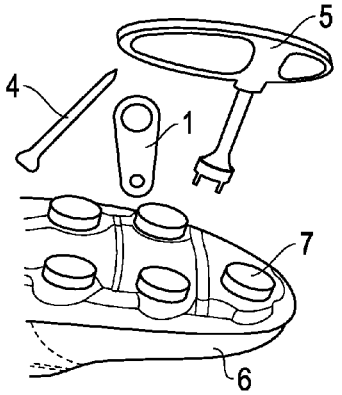

FIG. 2A. It shows all of the pieces required for installing the golf shoe holder with dismountable cleats.

Figure 2B:
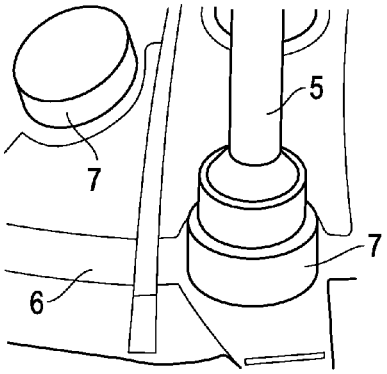

FIG. 2B. It shows how the winding key (5) is inserted in the cleat (7) to dismount the cleat.

Figure 2C:
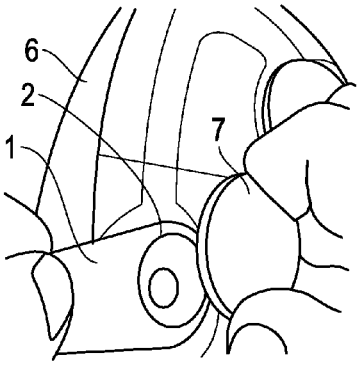

FIG. 2C. It shows how the golf shoe holder with dismountable cleats is installed (1) in the large hole (2) between the shoe sole (6) and the cleat (7).

Figure 2D:
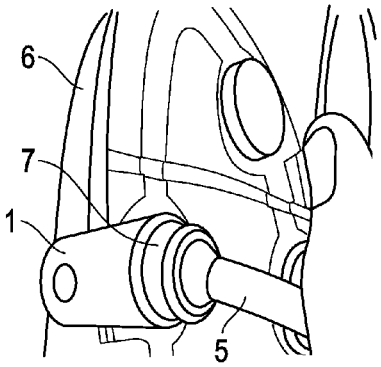

FIG. 2D. It shows how the cleat is tightened with the winding key (5).

Figure 2E:
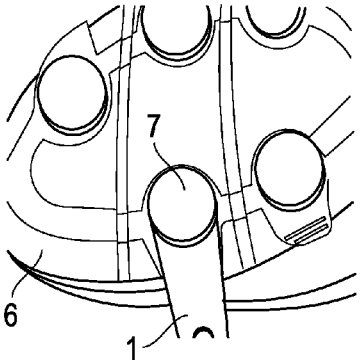

FIG. 2E. It shows how the golf shoe holder with dismountable cleats (1) is fixed to the shoe sole (6).

Figure 2F:
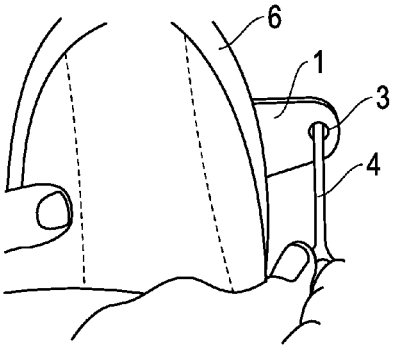

FIG. 2F. It shows how the tee (4) is inserted into the smaller hole (3) of the golf shoe holder with dismountable cleats (1).

Figure 2G:
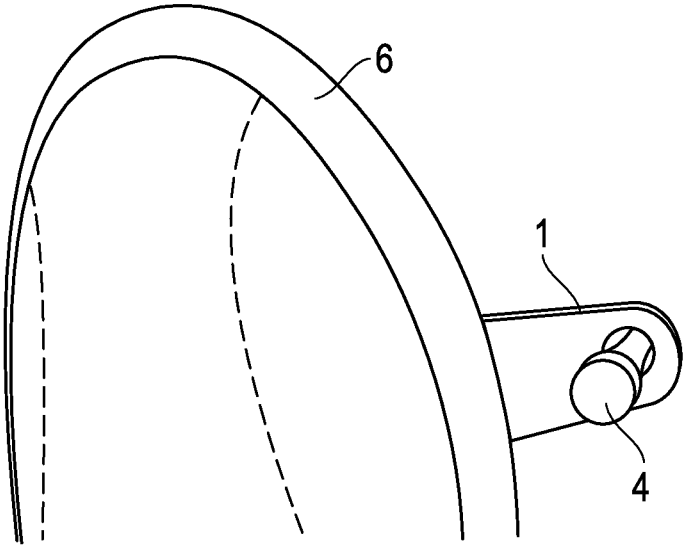

FIG. 2G. It shows how the tee (4) is totally introduced into the golf shoe holder with dismountable cleats (1) and this shall prevent the supporting foot from moving when attempting to hit the golf ball with the golf club.

REFERENCE LIST

| Number | Corresponds to: |
|---|---|
| 1 | Shoe holder with dismountable cleats |
| 2 | Large diameter hole |
| 3 | Small diameter hole |
| 4 | Tee |
| 5 | Winding key |
| 6 | Shoe sole |
| 7 | Cleats |

When looking at these figures, it may be observed how the golf shoe holder (1) with dismountable cleats (7) is structured, based on a single body part, elongated and thin, in a truncated cone (trapezoidal) form, elongated at the ends and rounded at said ends, with two holes: one with a large diameter (2) and one with a smaller diameter (3). The large diameter hole (2) is located at the widest end of the elongated part and the other hole, with a smaller diameter (3) is located far from the large hole (2) and close to the narrowest end of the part (1). They are used as follows: the large diameter (2) of the part (1) is to be placed within the cleats (7) and the shoe sole (6), by means of the threads (not shown) that both parts have and the smaller diameter hole (3) is where it is fastened to the grass by means of a tee (4).

Thus, the invention is focused on the fact that the supporting foot of a golfer does not move at the time of attempting to hit the golf ball with the golf clubs, as the golf shoe holder shall prevent this from happening.

To install the holder, firstly, the cleat (7) of the shoe is dismounted from the shoe sole (6) with the winding key (5) as shown in FIG. 2B. Then, the holder (1) is placed on the shoe sole (6) and the cleat (7) is put in place again, as shown in FIG. 2C and it is tightened with the winding key (5) as shown in FIG. 2D. Thus, it is placed and held to the shoe sole (6) as shown in FIG. 2E. FIG. 2F shows how the tee (4) is placed through the smaller hole (3) of the shoe holder (1) and, lastly, FIG. 2G shows how the tee (4) is dug into the ground, thus preventing the movement of the golf shoe.

The invention claimed is:

1. A method of affixing a shoe to the ground comprising:

obtaining a shoe affixer comprising:

a flat body having a first end and a second end, wherein the flat body is removably attachable to a sole of the shoe with a cleat;

a first hole in the flat body about the first end adapted to be installed between a cleat and a shoe sole, wherein the flat body is removably attached by compression of the flat body with the cleat to the sole of the shoe; and a second hole in the flat body about the second end adapted to removably hold a golf tee adjacent to the shoe sole, wherein a user can temporarily affix the shoe to the ground with a golf tee through the second hole;

securing the golf shoe affixer to the golf shoe by positioning the first hole of the shoe affixer between the cleats and the shoe sole, wherein the flat body is removably attached by compression of the flat body with the cleat to the sole of the shoe; and securing the shoe affixer to the ground by pinning a golf tee through the second hole of the affixer into the ground.

2. The method of claim 1, wherein the shoe affixer is rounded.

3. The method of claim 1, further comprising the step of adapting the shoe affixer for installation on either a right shoe or a left shoe.

4. The method of claim 1, further comprising the step of adapting the shoe affixer for installation on the cleat on a left side of a right shoe, a right side of a left shoe, a right side of a right shoe, or a left side of a left shoe.

5. The method of claim 1, further comprising the step of adapting the shoe affixer for installation on the cleat below a toe box of the shoe.

6. The method of claim 1, further comprising the step of affixing decals, designs, advertising legends, instructions, or labels to a portion of the shoe affixer that is exposed after being secured to a shoe.

7. The method of claim 1, further comprising the step of positioning the first hole of the shoe affixer between the cleats and the shoe sole further comprises dismounting the cleat from the shoe sole, placing the shoe affixer onto the shoe sole, remounting the cleat to the shoe sole over the first hole of the shoe affixer.

8. The method of claim 7, further comprising the step of dismounting and remounting the cleat to the shoe sole with a winding key.

* * * * *